United States Patent [19]

Merz

[11] 4,443,169

[45] Apr. 17, 1984

[54] GEAR PUMP

[75] Inventor: Johann Merz, Bopfingen, Fed. Rep. of Germany

[73] Assignee: Zahnradfabrik Friedrichshafen, AG, Friedrichshafen, Fed. Rep. of Germany

[21] Appl. No.: 229,067

[22] Filed: Jan. 28, 1981

[30] Foreign Application Priority Data

Feb. 15, 1980 [DE] Fed. Rep. of Germany ..... 3005657

[51] Int. Cl.[3] ..... F04C 2/10; F04C 15/04

[52] U.S. Cl. ..... 418/171; 418/15

[58] Field of Search ..... 418/171, 166, 15, 170

[56] References Cited

U.S. PATENT DOCUMENTS 3,170,409 2/1965 McLeod ..... 418/171
3,529,617 9/1970 Huber ..... 418/15

FOREIGN PATENT DOCUMENTS 2540879 7/1977 Fed. Rep. of Germany ..... 418/171
2904666 8/1979 Fed. Rep. of Germany ..... 418/171

OTHER PUBLICATIONS

Zahnradfabrik Friedrichshafen AG, Werk Schwäbish Gmund, ZF Lenkungen, p. 27.

*Primary Examiner*—Charles J. Myhre
*Assistant Examiner*—Carl Stuart Miller
*Attorney, Agent, or Firm*—& Shuster Zalkind

[57] ABSTRACT

A gear pump having an annular internal tooth gear and an external tooth gear eccentrically rotative therein is provided with a choke bore at the inlet side of the pump and a series of outlet pressure bores. The outlet bores are valved with individual check valves so as to pass pressure oil from the pressure pockets between the relatively moving gear teeth which pockets diminish in volume at the outlet side of the pump as the teeth move therepast and the pressure pockets discharge into the outlet bores. Where a pocket is insufficiently filled to effect the pressure needed for opening the first valves moved pass by the pressure pockets, the pressure increases with continued rotation as pocket volume decreases. The increase in pressure in the pockets with volume reduction ultimately opens an outlet bore valve to effect discharge to a common high pressure chamber. Thus, when pump speed is increased, a reduction in inlet suction fails to fully fill the pockets at the inlet zone and the valving arrangement prevents short circuit of flow or back feed from the high pressure common outlet chamber to partially filled pressure pockets at the inlet side causing a recirculation and energy loss. Such partially filled pockets will ultimately discharge as they are reduced in size to force out the oil therein at a valve opening pressure. Provision is made to prevent flow between adjoining pressure pockets.

5 Claims, 5 Drawing Figures

GEAR PUMP

STATUS OF THE PRIOR ART

Gear pumps having a gear within a gear are well known, for example in DE-OS No. 29 04 666 used for supplying lubricating oil to gear boxes and motors for hydraulic power steering systems, and the like. Basic features of such pumps are a suction inlet chamber and a pressure outlet chamber in an arrangement such that volume displacement in comparison with power requirements increases proportionally with increased speed. In general, the output volume is determined at a relatively low speed by a flow control valve on the outlet pressure side of the pump. Such an arrangement is illustrated in a publication of Zahnradfabrik Friedrichshafen AG, ZF Steering Systems with Accessories and Range of Pumps, page 27, ill. 59, dated August 1977. Such pumps are found to consume too much energy particularly with increase in speed.

There are also piston type pumps of radial piston design, for example, as shown in German Patent DE-PS No. 25 40 879. Such pumps have the advantage of so-called suction control in that output quantity is predetermined without losses in the suction bores of the pistons with increase of speed. Check valves are provided for respective pistons on the output pressure side to prevent feed back flow of hydraulic oil to the suction zone. However, radial piston pumps have a disadvantage in that they are relatively expensive to manufacture.

Heretofore attempts have been made to provide suction control of gear pumps by throttling the suction flow and such attempts have led to a constant delivery flow at output but have not achieved any saving in power. Further, the prior art arrangements are likely to lead cavitation.

BRIEF DESCRIPTION OF THE INVENTION

The purpose of the invention is to secure advantages of suction control in a gear pump in a manner that saves energy by preventing recirculation of oil in the pump and precluding cavitation in an economical construction.

The construction of the invention provides an inlet having a choke bore through which working fluid is drawn by suction from an inlet chamber feed from an oil tank. Such choke arrangement is used in conjunction with a series of check valves at the outlet side of the pump disposed for respective outlet pressure bores that communicate pressure chambers or pockets between the meshing teeth of the revolving gears to a common outlet chamber. The valves are opened by a certain amount of pressure to permit flow through the respective pressure bores into the outlet pressure chamber. The decreasing volume of the pressure pockets increases the pressure to the point where the check valves open for egress of pressure fluid. In one modification, the check valves are radially disposed leaf springs carried on a cheek plate covering individual pressure bores provided through the plate. In another modification the check valves are ball valves disposed in the valleys between teeth of the annular or ring gear. In the former instance, the outlet pressure chamber is generally kidney shaped while in the latter instance it is semi-circular and formed in the pump housing.

By an arrangement of check valves as generally described above, the oil in the common outlet pressure chamber fed by the individual bores swept by the pressure pockets cannot feed back to partially filled pockets between the gears in the pressure outlet zone. Such pockets being only partially filled due to the throttling of inlet flow on the suction side of the pump for flow control would simply receive oil for recirculation and consequently use additional power. Accordingly, there is a saving of energy controlled by the valve arrangement at the outlet side of the pump in the present invention. Suction control is easily predetermined by a choke bore with a minor construction change as compared to conventional designs and at a minimum of expense.

A description of the invention now follows in detail in conjunction with the appended drawing in which.

Figure 1:
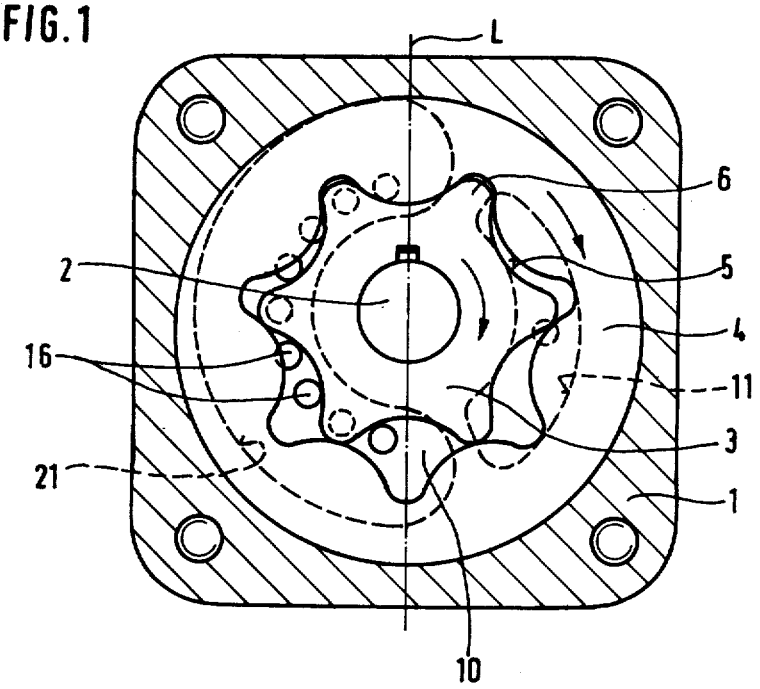
FIG. 1 is a radial section of the gear pump of the invention showing the individual pressure outlet bores relative to the gears of the pump.
Figure 2:
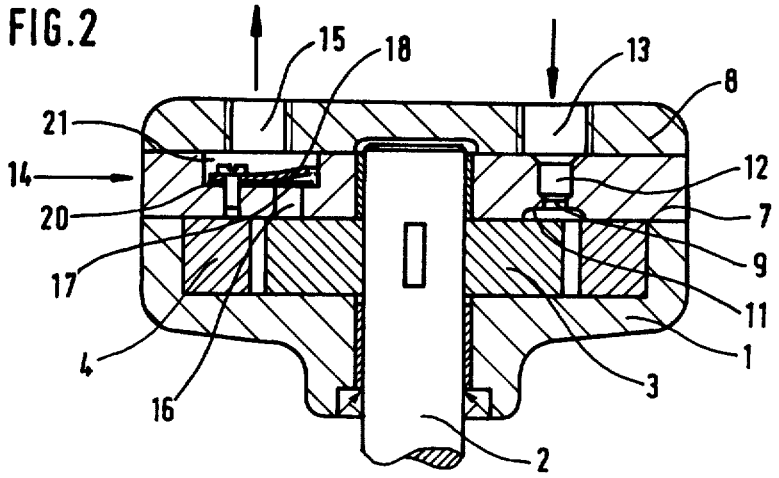
FIG. 2 is a longitudinal section illustrating the relationship of the pump gears, the cheek plate and the check valves overlaying the outlet pressure bores at the downstream ends.
Figure 3:
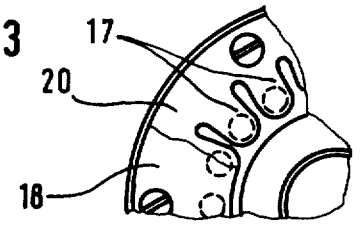
FIG. 3 is a fragmentary radial view showing the check valves overlaying the outlet pressure bores.

Referring now to FIGS. 1–3, the invention comprises a housing 1 having drive gear 3 connected for rotation by shaft 2 and being within annular or ring gear 4. Gear 4 has teeth 5 meshing with teeth 6 of gear 3, there being one less tooth 6 than the number of teeth 5 on gear 4, a well known construction.

The gears rotate in a housing, i.e., between housing 1 and a cheek plate 7. The cheek plate together with the housing lid 8 will be understood to be fastened in any suitable conventional manner, usually by screws (not shown) to the housing 1.

In the course of rotation of the gears 3 and 4 the meshing of teeth 5 and 6 form pressure pockets 10 which cyclically open wide at the suction zone of the pump and progressively decrease in volume in the pressure zone, all as is well known.

As the pressure pockets increase in volume they sweep past a kidney shaped suction chamber 11 formed in cheek plate 7 which suction chamber is fed via a choke bore 9 and a bore 12 in the cheek plate communicating with a suction connection bore 13 in the lid for communication with a tank (not shown). When pressure pockets 10 between the meshed gear teeth move past a longitudinal central plane L which bisects the construction and into the suction zone of suction chamber 11, as seen in FIG. 1, they increase in volume in a well known manner to suck in oil.

The cheek plate 7 carries a series of one way check valves 14 at the high pressure zone of the pump which control flow to an outlet connection 15 provided in the lid 8 for connection to a pressure consumption device. The valves 14 comprises respective pressure bores 16 in arcuate array about the axis of driving gear 3 longitudinally through the cheek plate, each such bore being covered by a flexible tongue 17 of a valve 14 opening upwardly as viewed on FIG. 2 when sufficient pressure is effected in a respective bore 16. The flexing movement of the valve tongues is limited by a rigid semi-circular metal segment 18 which will be seen to be bent upwardly at its inner periphery as seen in FIG. 2 spacedly overlying all the valve tongues 17 to permit predetermined flexing of the individual valve tonges 17. Such tongues 17 can be formed from a single arcuate member of flexible material 20 of semi-circular extent and the members 18 and 20 may be fastened by screws as shown to cheek plate 7.

The arcuate distance between pressure bores 16 is selected so that the teeth 6 of gear 3 fully cover these bores in order to avoid a loss of fluid between adjacent pressure pockets. This is clearly seen on FIG. 1 wherein the pressure bores to which numeral 16 extends are within a pressure pocket bounded by pressure bores shown in dotted lines covered by teeth 6. The same prevention of fluid feed back can be had if the pitch circular diameter of the arc on which pressure bores 16 are disposed is radially increased so that the teeth 5 of the annular gear 4 cover them to prevent fluid passage between adjacent pockets.

The tongues 17 of check valves 14 are predetermined in stiffness to open at a predetermined pressure for a low rate of pump speed when all pressure pockets 10 are presumably filled. Thus, such pressure occurs when the pressure pockets 10 are completely filled with oil as at the beginning of a pressure stroke, i.e., a decrease in volume. The beginning of a pressure stroke when pressure pockets start to decrease in volume is illustrated in FIG. 1 by the lowermost pressure pocket indicated by reference numeral 10. Accordingly, the entire zone in which the pressure bores 16 are disposed can be used for delivery of oil if all pressure pockets are completely filled as they move with decreasing volume from the position of the lowermost pocket past the outlet pressure zone of kidney shaped outlet chamber 21. If the pump speed increases the effect of the choke bore 9 is to cause the pressure pockets 10 to be only partially filled. Partially filled pockets cannot create sufficient pressure to open check valves 14 at the beginning of movement of the pressure pockets into the pressure zone of the pump. Accordingly, the decreasing volume of the pressure pockets takes up the otherwise empty space and each pressure pocket becomes a completely filled volume with increase of pressure as the volume continues to decrease. This, then, is sufficient to open check valves 14 toward the end of the pressure zone, only the upper region of pressure bores as seen in FIG. 1. However, the unopened check valves 14 prevent a back feed flow into partially filled pressure pockets 10 from the high pressure region of the pressure zone, i.e., from the outlet chamber 21. This precludes the deleterious recirculating energy loss effects which occur at higher pump speeds due to the suction control effect of the bore 9.

Figure 4:
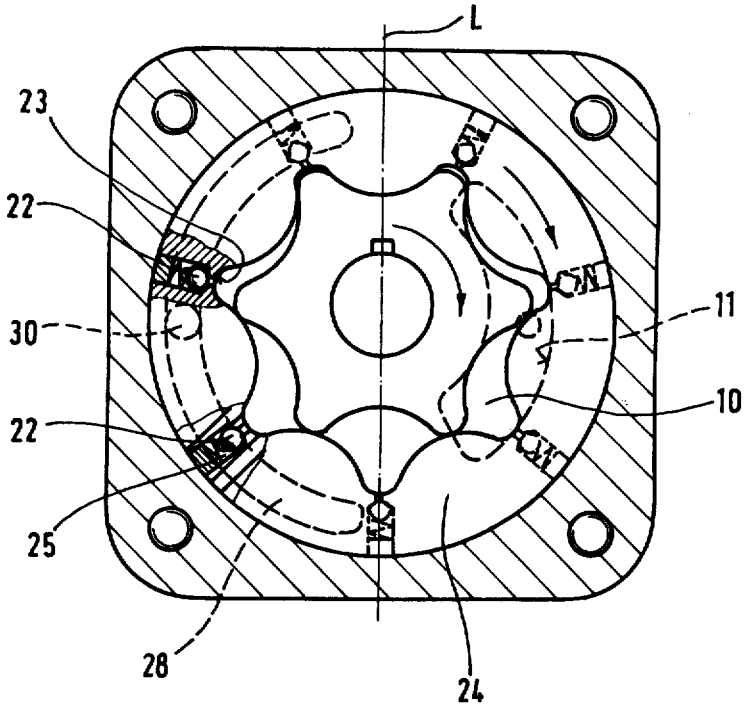
FIG. 4 is a radial section of a modification wherein the teeth of the ring gear are provided with individual check valves at the upstream ends of the outlet pressure bores.
Figure 5:
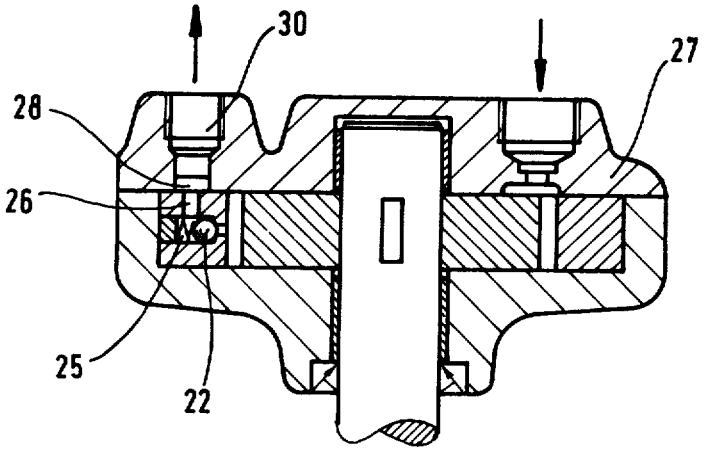
FIG. 5 is a longitudinal section showing the relationship of one of the check valves with the other components of FIG. 4.

The modifications shown in FIGS. 4 and 5 provides a ball check valve 22 radially disposed in the valleys between the teeth 23 of the ring gear 24. Thus, a radial bore 25 is provided in each such valley communicating through a respective axial outlet bore 26 with a semi-circular outlet chamber 28 in the housing lid 27. The outlet chamber 28 communicates with an outlet connection 30 in the lid. In this modification as the check valves pass through the pressure zone at the left of a longitudinal plane designated by the phantom line L, all are opened under predetermined pressure for oil passage. Thus, any check valve 22 in the area of the kidney shaped suction chamber 11' is always closed since there is insufficient pressure to effect their opening as the pressure pockets 10' widen with low suction pressure present. Accordingly, the fact that the check valves 22 actually rotate with the gear has no effect on their operation, which is in the same manner as the check valves 14 of the modification shown in FIGS. 1-3, to prevent a flow back from the high pressure pockets and the outlet chamber to the low pressure pockets which are only partially filled at higher pump speeds.

Accordingly, both modifications of the invention minimize the energy required for pump operation and cavitation by avoiding any need to recirculate oil in the pump.

The modification of FIGS. 4 and 5 has an advantage in foreshortening the axial length of the pump, no cheek plate being used.

I claim:

1. A gear pump of the kind comprising a ring gear having therein an eccentrically mounted meshing driving gear wherein pressure pockets are cylically effected between meshing teeth varying in volume so as to progressively increase in volume at an inlet pressure zone and progressively decrease at an outlet pressure zone;

choke means at the inlet pressure zone through which fluid passes to said pressure pockets during increase of volume of said pressure pockets;

means effecting a plurality of outlet pressure passages communicatable with said pressure pockets at said outlet pressure zone and having check valves openable in response to pressure increase in said pressure pockets for flow through said outlet pressure passages during decrease in volume at said outlet pressure zone;

including a housing for said gears and means closing said housing comprising a member having said outlet pressure passages therethrough;

means providing a respective check valve for each said outlet pressure passage, wherein said member is a cheek plate contiguous with the faces of said gears and said outlet passages comprise outlet pressure bores arcuately arrayed about the axis of rotation of said driving gear;

said cheek plate having a recess in said outlet pressure zone to effect a common outlet chamber communicating with said outlet pressure bores.

2. A gear pump as set forth in claim 1, wherein the teeth of one of said gears in relation to the arcuate spacing of said bores effects blocking of flow through said bores between adjacent pressure pockets.

3. A gear pump as set forth in claim 1, wherein said check valves comprise flexible tongues covering respective outlet pressure bores and being carried by said cheek plate and being operative to be flexed to pass flow at predetermined pressure from respective outlet pressure bores to said common outlet chamber.

4. A gear pump as set forth in claim 3, including means for limiting the flexing of said tongues.

5. A gear pump as set forth in claim 4, said tongues being integrally formed from a common semi-circular member of flexible material and said means for limiting flexing being a relatively rigid arcuate member spacedly overlying said tongues.

* * * * *